US007969304B2

(12) United States Patent
Berland et al.

(10) Patent No.: US 7,969,304 B2
(45) Date of Patent: Jun. 28, 2011

(54) SECURED BAG LOCKING AND TRACKING DEVICE

(76) Inventors: Kerry S. Berland, Chicago, IL (US); James Ensinger, Buffalo Grove, IL (US)

( * ) Notice: Subject to any disclaimer, the term of this patent is extended or adjusted under 35 U.S.C. 154(b) by 557 days.

(21) Appl. No.: 12/111,644

(22) Filed: Apr. 29, 2008

(65) Prior Publication Data

US 2009/0268989 A1 Oct. 29, 2009

(51) Int. Cl.
*G08B 13/14* (2006.01)

(52) U.S. Cl. ..... 340/568.1; 340/568.2; 340/568.3; 340/568.4; 24/30.5 R; 235/382; 235/385

(58) Field of Classification Search ..... 340/568.1, 340/568.3, 571, 572.1, 572.8, 572.9, 686.1–686.6, 340/568.2; 700/228; 235/375–385; 24/30.5 R
See application file for complete search history.

(56) References Cited

U.S. PATENT DOCUMENTS 4,428,098 A * 1/1984 Coker et al. ..... 24/30.5 R
5,615,625 A * 4/1997 Cassidy et al. ..... 109/45
5,616,625 A 4/1997 Hung et al.
5,648,763 A 7/1997 Long
5,825,283 A 10/1998 Camhi
6,057,779 A 5/2000 Bates
6,370,222 B1 4/2002 Cornick, Jr.
6,556,138 B1 4/2003 Sliva et al.
6,707,381 B1 3/2004 Maloney
6,753,775 B2 6/2004 Auerbach et al.
6,826,607 B1 11/2004 Gelvin et al.
6,847,892 B2 1/2005 Zhou et al.
6,850,252 B1 2/2005 Hoffberg
6,859,831 B1 2/2005 Gelvin et al.
6,865,926 B2 3/2005 O'Brien et al.
6,975,224 B2 12/2005 Galley, III et al.
6,988,026 B2 1/2006 Breed et al.
6,995,840 B2 2/2006 Hagler
7,002,472 B2 2/2006 Stratmoen et al.
7,020,701 B1 3/2006 Gelvin et al.
7,027,773 B1 4/2006 McMillin
7,041,941 B2 5/2006 Faries, Jr. et al.
7,082,359 B2 7/2006 Breed
7,089,099 B2 8/2006 Shostak et al.
7,103,460 B1 9/2006 Breed
7,205,016 B2 4/2007 Garwood
7,212,098 B1 5/2007 Trent et al.
7,257,987 B2 8/2007 O'Brien et al.
7,276,675 B2 10/2007 Faries, Jr. et al.
7,307,245 B2 12/2007 Faries, Jr. et al.
7,313,467 B2 12/2007 Breed et al.
7,317,393 B2 1/2008 Maloney
7,319,397 B2 1/2008 Chung et al.
7,333,015 B2 2/2008 Ekstrom
7,339,469 B2 3/2008 Braun
7,342,497 B2 3/2008 Chung et al.
7,715,277 B2 * 5/2010 de la Huerga ..... 368/10
7,760,094 B1 * 7/2010 Kozischek et al. ..... 340/572.1
(Continued)

*Primary Examiner* — Benjamin C Lee
*Assistant Examiner* — Peter C Mehravari

(57) ABSTRACT

A secure container for controlling and monitoring access to at least one secured bag locking device is disclosed. The secure container is lockable to prevent access by unauthorized parties, and may include any feature of prior art secure containers, such as shock detection or a camera to photograph access. The secure container contains a number of rails to provide power to and monitor the status of docked secured bag locking devices. In addition, the secure container includes an antenna to allow secured devices to be tethered to it via communications with an active radio frequency identification tag secured to the tethered device.

6 Claims, 9 Drawing Sheets

U.S. PATENT DOCUMENTS

2003/0179073 A1 9/2003 Ghazarian
2006/0116899 A1* 6/2006 Lax et al. ..... 705/1
2006/0273180 A1* 12/2006 Ammond et al. ..... 235/492
2007/0145064 A1* 6/2007 Clauser et al. ..... 221/197
2007/0164858 A1 7/2007 Webb
2007/0171060 A1 7/2007 Trent et al.
2010/0265068 A1* 10/2010 Brackmann et al. ..... 340/572.1

* cited by examiner

SCANNING UNITS IN STORAGE

SECURED BAG LOCKING AND TRACKING DEVICE

CROSS-REFERENCE TO RELATED APPLICATIONS

This application claims priority under 35 U.S.C. §119(e) from U.S. Provisional Patent Application No. 60/862,582, entitled "SECURED BAG LOCKING AND TRACKING DEVICE," filed on May 3, 2007, which is hereby included by reference in its entirety.

FIELD OF THE INVENTION

The field of invention relates generally to secure storage containers, and more specifically to a secured bag locking and tracking device, and more particularly still to a secured bag locking and tracking device for securing plastic bags to a secured container.

DESCRIPTION OF THE PRIOR ART

Different methods of securing containers have been developed within the prior art. A typical secure container consists of a rugged box intended to house valuable and/or sensitive items. While details may vary, a state of the art secure container provides some or possibly all of the features described in the following paragraphs.

A secure container generally will provide one or more locks, allowing access to the contents of the secure container only to authorized personnel. Locks may be mechanical, but may also include an electrical switch that detects its state, i.e., whether it is locked or unlocked. The contacts of this switch generally report the state of the lock to a monitor board that logs whether the lock is locked or not.

In addition, a secure container will usually include a control board, which is a microprocessor-based circuit board that connects to the lock switch, as well as other sensors as described below. Generally, the control board will contain a processor of some kind, some amount of non-volatile memory, a real-time clock, and a data access port. The processor will usually be a microcontroller or microprocessor, but other types of processors could be used as well, for example, a digital signal processor could be used. The non-volatile memory maintains container events, such as the opening and closing of the container. The data access port, which could be, for example, a simple RS232 serial port, a USB port, or a wireless Bluetooth access port, is used to download data records to authorized personnel. The real-time clock maintains the date and time and is used to time stamp container events.

The secure container may also contain a shock sensor, such as a three-axis accelerometer. The shock sensor may be used to generate an alarm to indicate that the contents of the secure container have been subjected to a shock, or that a party may be attempting to force their way into the container. Other anti-intrusion measures may include a motion detector, such as a passive infrared sensor to detect motion within the container, and a light sensor. In addition, for secure containers designed to contain sensitive items, a temperature sensor and/or humidity sensor may be provided.

Certain evidence containers also utilize a camera to photograph an image of each person who opens the container. A flash lamp is used to illuminate the person opening the container to ensure a good image.

A GPS module may be used to track the location of the secure container, and a wireless modem module may be used to relay location information and other status information to a querying computer. Most secure containers are fitted with an alarm, which generates a loud noise when an intrusion attempt is detected. Finally, to power the aforementioned electronics, a battery pack, battery charger, and charge sensor are required as well.

Examples of prior art secured container and shipment systems can be found in U.S. Pat. Nos. 5,615,625, 5,648,763, 5,825,283, 6,057,779, 6,370,222, 6,556,138, 6,707,381, 6,753,775, 6,826,607, 6,847,892, 6,850,252, 6,859,831, 6,865,926, 6,975,224, 6,988,026, 6,995,840, 7,002,472, 7,020,701, 7,027,773, 7,041,941, 7,082,359, 7,089,099, 7,103,460, 7,205,016, 7,212,098, 7,257,987, 7,276,675, 7,307,245, 7,313,467, 7,317,393, 7,319,397, 7,333,015, 7,339,469, and 7,342,497, as well as U.S. patent application Ser. Nos. 10/392,663, 11/321,376, 11/336,126, and 11/727,311, all of which are hereby incorporated by reference in their entirety.

OBJECTS OF THE INVENTION

Other advantages of the disclosed invention will be clear to a person of ordinary skill in the art. It should be understood, however, that a system, method, or apparatus could practice the disclosed invention while not achieving all of the enumerated advantages, and that the protected invention is defined by the claims.

SUMMARY OF THE INVENTION

This invention relates to a system for securing and tracking items that are clamped within plastic bags. Intended for use in conjunction with a secure container system, this invention provides an electronic record showing continuous custody of the items that are inserted into the attached plastic bags.

The secured bag locking and tracking device (SBLTD) comprises an assembly with a clamp base and a clamp arm. When the clamp arm is open, the neck of a plastic bag can be inserted into the unit. When the clamp arm is closed and latched, the plastic bag is clamped securely. A special tool is required to release the clamp.

An electrical switch within the device monitors the state of the clamp. Within the unit is electronic circuitry that tracks and monitors the security of the bag.

An example application is the handling of articles of evidence in a criminal investigation. Each article of evidence is placed into a plastic bag, which in turn is clamped into a SBLTD. Each SBLTD is placed into a rack within a secure container. The secure container is closed and locked. While the SBLTD devices are latched into the rack, a host controller within the secure container periodically interrogates them, in order to establish continuous custody of the items of evidence. The host controller maintains a log of all events, and will generate an alarm should it ever detect removal of an SBLTD.

In the event that an item of evidence is too large to fit within the secure container, it is placed in a larger plastic bag, which is secured by an SBLTD. The large item of evidence is kept close to the secure container. In this mode of operation, the SBLTD is electronically tethered to the host controller within the secure container, through a radio frequency (RF) data link.

Another example application is a transportation container intended for shipment of emergency medical supplies to remote locations. Medical supplies are placed in bags, which are secured by SBLTD devices, which in turn are held in racks within the medical container.

A further example would be to electronically tether a SBLTD to a delivery truck. Such a system could be used, for example, to guarantee that controlled substances, such as morphine, were delivered properly.

Yet another example application would be electronically tethering the SBLTD to a handheld or portable device, such as a PDA, laptop computer, cellular telephone, or similar devices.

The electronic circuitry within each SBLTD implements three means of tracking and identifying the bag attached to the SBLTD.

Mode 1 (Inside the secure container): The SBLTD includes a three-wire electrical connector that plugs into contacts in a rack within the secure container. Two contacts provide battery power to the SBLTD, and the third is a single-wire data communications bus line. When the secure container is closed and locked, the host controller within the secure container periodically interrogates all of the SBLTD devices within, using the single-wire data communications bus, in order to maintain a record of continuous custody.

Mode 2 (Electronically tethered to the secure container): The SBLTD includes a rechargeable battery that allows it to operate for an extended period without an external power connection. When the SBLTD is clamped to a plastic bag, but is not plugged into a secure container rack, it turns on a radio frequency data communications transceiver, communicating with a matching RF transceiver within the secure container. This RF data link effectively provides an electronic tether as between the SBLTD and the secure container. The host controller within the secure container periodically interrogates all of the tethered SBLTD devices nearby to maintain a record of continuous custody.

Mode 3, Secure Storage: Each SBLTD includes a radio frequency identification (RFID) integrated circuit, connected to an RFID antenna. This device includes nonvolatile memory that is programmed by the microcontroller within the SBLTD. This memory includes records indicating the time and date for each opening and closing of the clamping device on the SBLTD. When the SBLTD is in storage mode—not inserted into the rack within the secure container, and not actively communicating via RF data link with a secure container—it automatically switches itself off, to conserve power. But the device will automatically wake up should it detect an opening of the latch switch, record that as an event in its data log, and go to sleep again. While in storage mode, a handheld RFID scanner can be used to interrogate each SBLTD in the storage area. An evidence technician can inventory all evidence items in storage, retrieving the event log file from each device.

More particularly, the claimed invention achieves its objectives by providing a secure container for controlling and monitoring access to at least one secured bag locking device. Each secured bag locking device is constructed to include a clamp for securing a bag, and a data port for communicating status information. The secure container further comprises a lock to restrict access to the interior of the secure container only to authorized personnel. In addition, the container contains one or more docking positions including a power connection and an occupancy sensor to detect whether a secured bag is indeed docked at that position. The docking positions may comprise a rail including a negative contact and a positive contact, as well as a serial data pin. The contacts supply power to and detect the presence of a docked secured bag locking device. The data pin is used to monitor status information from the docked secured bag locking device. Further, the secure container includes an output device, such as a loud alarm speaker, for indicating whether a clamp on a docked secured bag locking device unexpectedly opens.

In an alternate embodiment of the disclosed invention, each secured bag locking device also includes an active radio frequency identification tag by which it may be tethered to a secure area, such as by a RF tethering device placed in the center of the area. In this embodiment the secured bag locking device would also include an indicator, such as an LED, to show when it was tethered to a particular location or device.

In yet another alternate embodiment of the disclosed invention, each secured bag locking device would also have a label affixed to its body to allow people handling the protected items to identify them visually without need of special equipment. In this embodiment, a label would be imprinted, for instance during the evidence collecting process, by using a small printer with a built-in alphanumerical keypad. A printer, such as those used for printing car rental receipts, could be used, except adapted to label stock rather than receipts. In this embodiment, each printable label would incorporate a passive Radio Frequency Identification ("RFID") tag. At the same time that the written description of its contents is being printed in human-readable characters on the label, the printer also stores that description on RFID tag. Label printers that incorporate RFID tag read/write circuits are commercially available.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE ILLUSTRATED EMBODIMENT

Figure 1A:
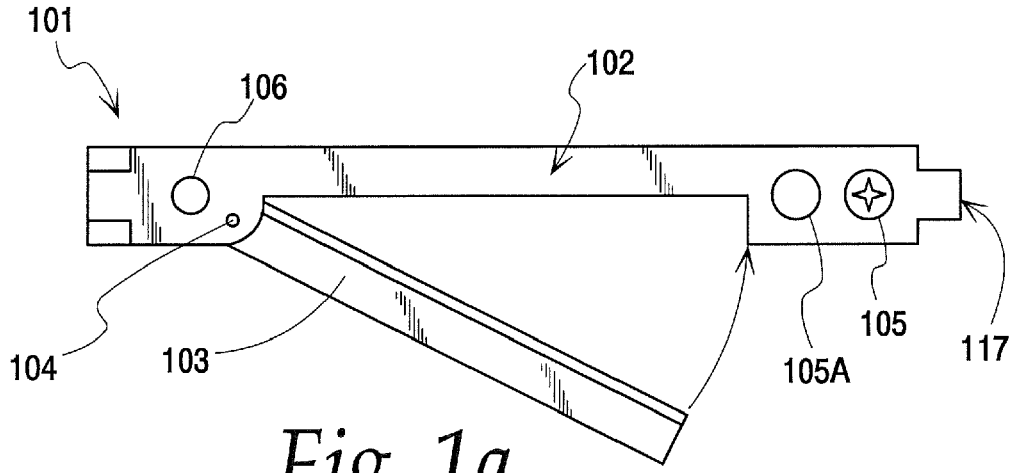
FIGS. 1A-1D are, respectively, top, bottom, right side, and left side drawings of a secured bag locking and tracking device constructed in accordance with an embodiment of the disclosed invention.
Figure 1B:
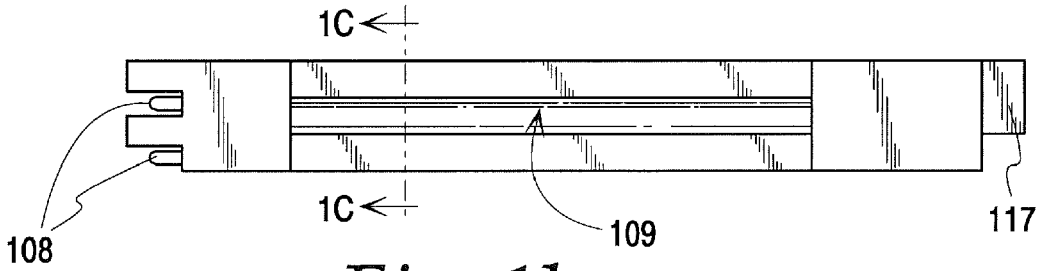
Figure 1C:
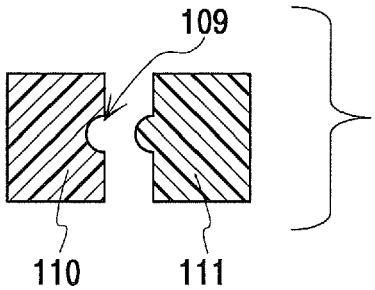
Figure 1D:
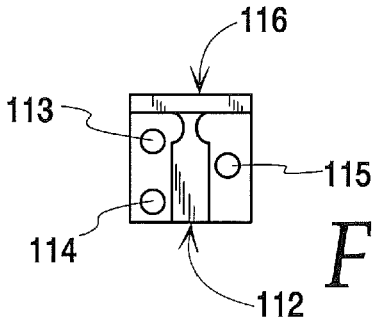

An improved secure container is disclosed. The improved secure container verifies that items contained within it are not removed. Further, the improved secure container allows items too large to fit within the secure container to be tethered to the secure container, so that those items are verified to be within some distance of the secure container. RFID tags may be used for these purposes.

One way to secure items within a secured container would be to simply affix off-the-shelf passive RFID tags to each item. In this scheme, an embedded RFID reader within the secure container would periodically interrogate the tags within the secured container.

A passive RFID tag contains no battery or other internal source of power. Its antenna absorbs RF energy from an RFID scanner—power circuitry within the tag rectifies and filters the RF energy, and the resulting DC voltage powers the RFID tag. The RFID tag sends its stored data back to the scanner by modulating the RF energy emitted by the scanner, using a predetermined coding scheme. Some passive RFID tags simply contain a factory-programmed serial number. Many passive RFID tags also contain an array of programmable non-volatile memory for storing data received from the RFID scanner, for later retrieval.

However, while this scheme is potentially workable, there are a number of drawbacks with a scheme in which passive RFID tags are simply affixed to items within a secure container.

First, RFID tag interference would be a problem. For proper operation, RFID tags must be spaced a minimum distance apart. For example, if many evidence bags, each affixed with a passive RFID tag, are tossed randomly into a secured area, the tags on some of these items will tend to land very close together. In that case, the RF field from the RFID scanner will be insufficient to power up the circuitry within the tags. As a general rule of thumb, the spacing between tags must be at least as much as the largest dimension (length) of the antenna structure within the RFID tag. Therefore, some kind of mechanical structure would have to be imposed on the system, to keep the RFID tags separate. This complicates a system using passive RFID tags alone to monitor secured items.

Second, the transmission power of the scanner could be problematic. A relatively significant amount of power must be expended to send RF energy through the air, from the RFID scanner, to the passive RFID tags. The more tags, the more power is required to ensure that all tags within the secured space will power up. For a large number of tags, this could require several watts of power. This power requirement could be a significant disadvantage. First, the RF energy required may exceed permissible RF radiation levels. Second, the amount of power required may be impractical for a device intended to be powered by batteries, for example, a transportable secure container. On a similar note, the physical size of the antenna would have to be significant to focus RF energy to all corners of a secured space, and generally, larger antennas cost more.

Third, data crosstalk could be an issue. RF energy from the RFID scanner within the secure container will tend to propagate outside the limits of the secured area. This could cause data crosstalk, for example, as between two secured containers located close to each other. To prevent such crosstalk in a system that uses an RFID scanner within the secured area to maintain item custody, one could provide a Faraday shield around the secured area. In the case of a secured container, an effective, RF leak-proof metallic shield would be difficult to fabricate, heavy, and expensive.

Fourth, the issue of actually securing the RFID tag to the stored item would have to be dealt with. A typical passive RFID tag consists of a paper label with the RFID chip and antenna built in. No special means are provided for securing the RFID tag to an item, or for monitoring that the item is so secured.

For tethering items to a secured container, one potential solution would be to secure off-the-shelf active RFID tags to the items to be so secured. The tethering device would then periodically scan the RFID tags, and ensure the tags were still within range of the scanner.

An active RFID tag has an internal source of power, typically a battery pack. Otherwise its functionality is similar to a passive RFID tag. Because it has an internal source of power, an active RFID tag requires only a fraction of the amount of RF energy from the scanner, to communicate. This substantially increases the effective range of the system, measured as the distance between the RFID scanner and the active RFID tag.

The concept of an active RFID tag to tether remotely located items to a secured area is effective in certain instances. However typical active RFID tags lack several desirable features for the present application:

First, there is no means for demonstrating connectivity. A typical active RFID tag provides no means for a user to determine that it is currently effective—in other words that the secured device is actually being monitored by the controller within the secured area.

Second, as with passive RFID tags, there is no means of actually securing the RFID tag to the tethered item. A typical active RFID tag consists of a simple plastic housing. No special means are provided for securing the active RFID tag to an item, and monitoring that the item is so secured.

Accordingly, given the disadvantages with simply affixing a passive or active RFID tag to an item to be monitored, a more sophisticated scheme is also disclosed.

Turning to the Figures, and FIG. 1 in particular, a secured bag locking and tracking device 101 constructed in accordance with the disclosed invention is depicted. Clamp base 102 makes up the largest part of this device. Clamp arm 103 opens up to receive the bag to be secured, rotating about hinge pin 104. The user first closes clamp arm 103 so that it grips the neck of the bag, and then pushes clamp latch button 105A, which locks clamp arm 103 in place. A special tool is required to open up the clamp using clamp release feature 105.

U-shaped crimp area 109 is intended to make positive contact with the neck of the secured bag. Another view of this crimp feature is shown in the side view of the clamp base 110 and clamp arm 111. The side view of the clamp base shows spring-loaded electrical interface pins 108 positioned on one end of the device. An end view shows the contact end of the clamp base, including positive contact pin 113, negative contact pin 114, and data pin 115. At the non-electrical side of the device, locking feature 117 serves to help lock the device into one of the rails within the secured area.

Figure 2:
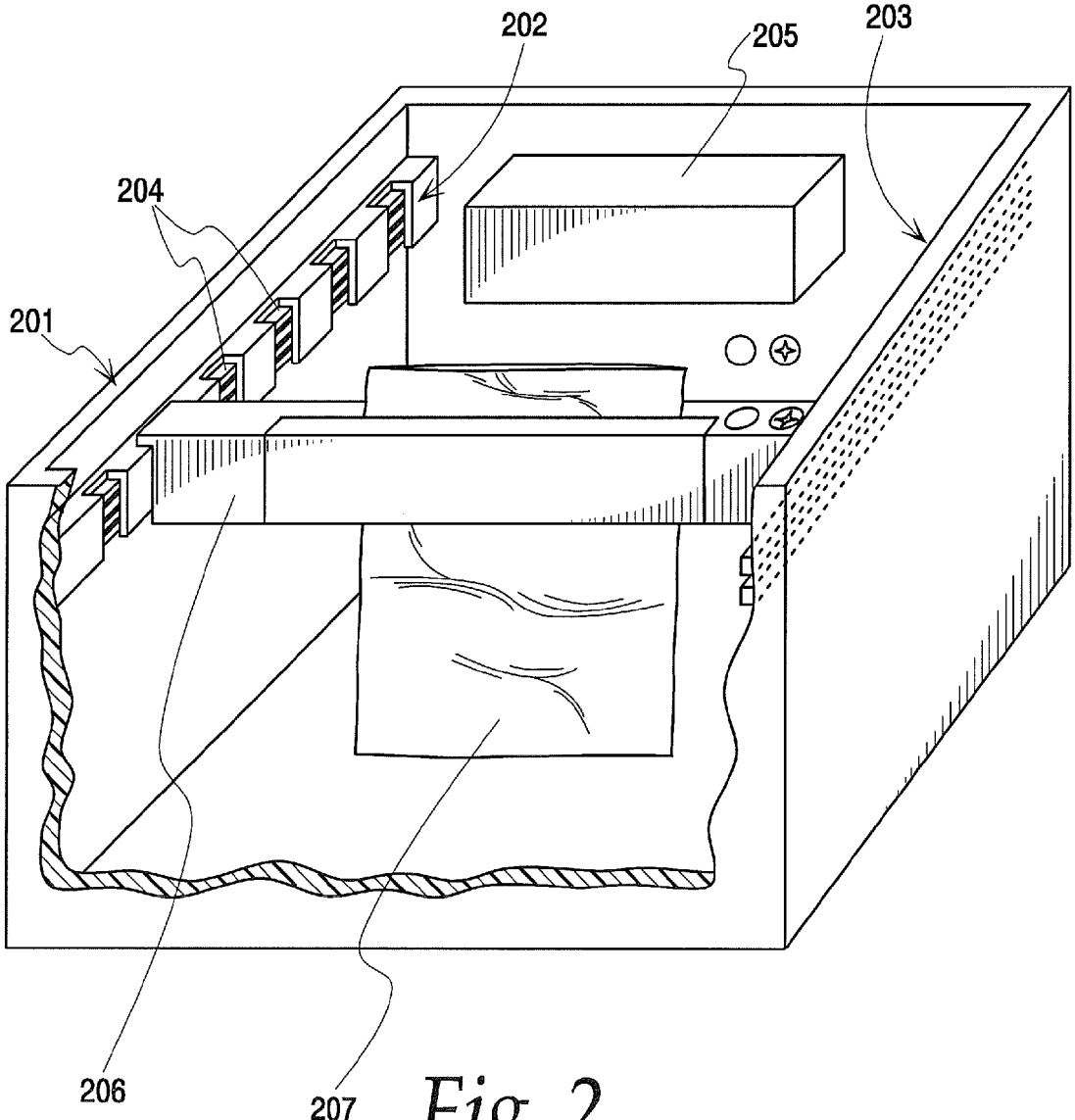
FIG. 2 is a secured container constructed in accordance with an embodiment of the disclosed invention.

FIG. 2 shows a typical secured area constructed in accordance with the disclosed invention. In this case, a section of a secure container 201 is shown. Along one edge is electrical contact track 202, which both supports multiple SBLTD devices, and provides electrical contacts for activating the devices. Along the other edge is mechanical-only track 203, which supports the SBLTD units.

FIG. 2 shows just one Secured Bag Locking and Tracking Device 206. Evidence bag 207 is suspended below. A number of notches 204 are provided along electrical contact track 202. Similar notches are provided along mechanical-only track 203. This allows a number of SBLTD devices to be placed within the secured container. The electrical contacts within electrical contact track 202 are connected to electronic control unit 205, which monitors the status of SBLTD units in the secure container.

Figure 3:
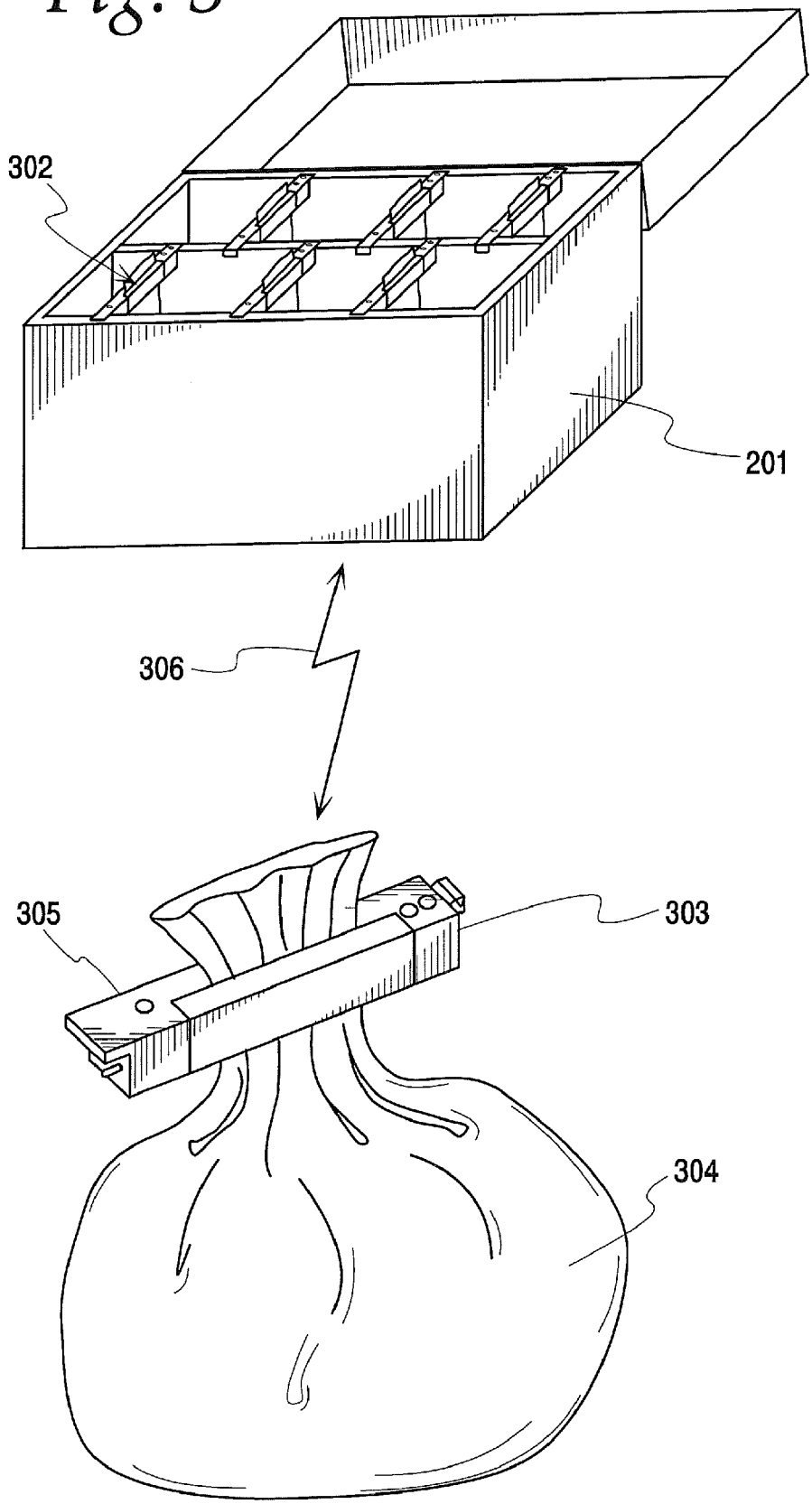
FIG. 3 is an illustration of the operation of a system for securing plastic bags constructed in accordance with an embodiment of the disclosed invention.

FIG. 3 illustrates the secure container of FIG. 2 201, with its access door open. Within it are multiple evidence bags 302, each secured by a respective SBLTD unit. Outside the secured container is SBLTD 303. Large plastic bag 304 contains large objects that could not have fit within secure container 201. SBLTD 303 communicates with the control unit within secure container 201 via a RF data link 306, which serves to tether SBLTD 303 to secure container 201. LED 305 blinks periodically on SBLTD 303 to provide a positive indication to a user that SBLTD 303 is electronically tethered to secure container 201.

Figure 4:
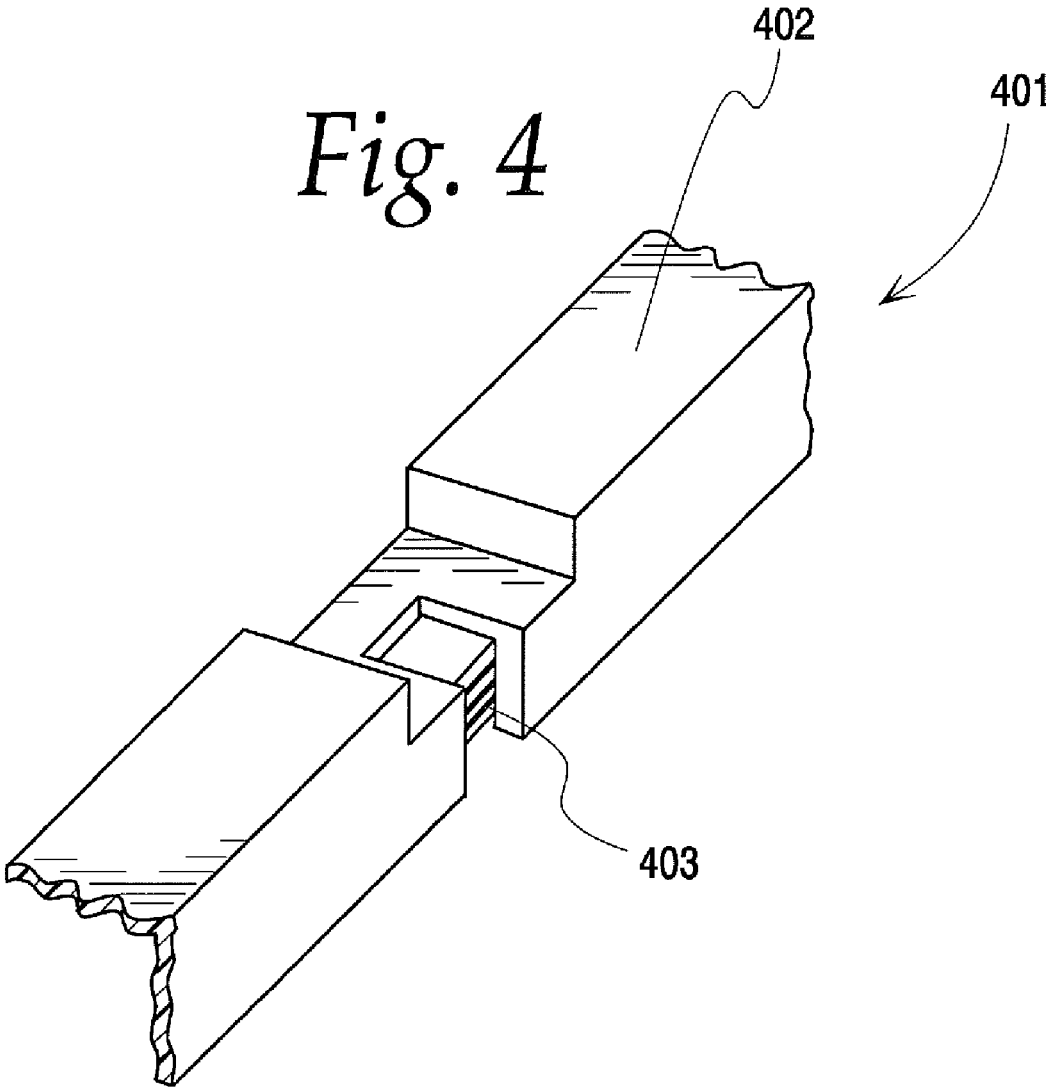
FIG. 4 is an exploded view of the securing mechanism and electrical rails used within the secured container of FIG. 2.
Figure 4:
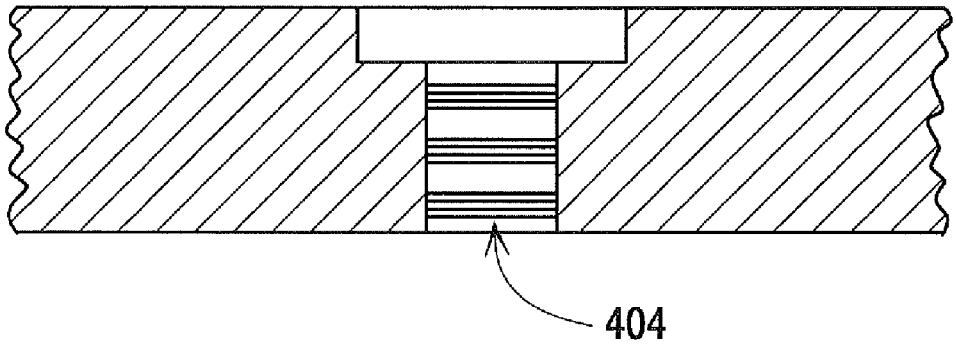

FIG. 4 provides details of the electronic contacts within track 401, which is also shown in FIG. 2 as element 204. Plastic track body 402 is furnished at a regular interval with an opening 403 which exposes three electrical rails 404 within the track. Spring-operated pins within an SBLTD device make contact with electrical rails 404.

Figure 5:
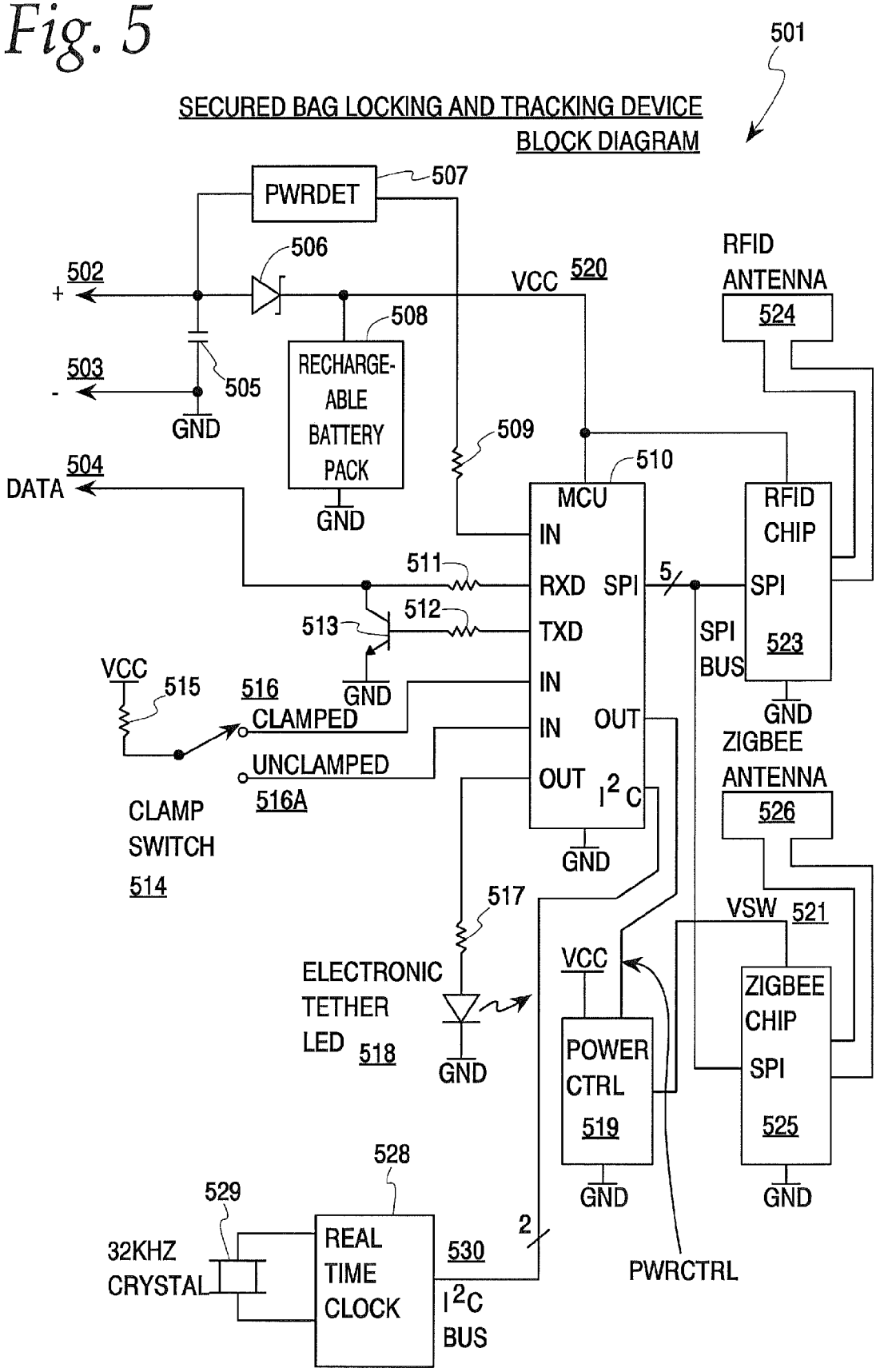
FIG. 5 is a high-level schematic view of the electronic components required to implement a secured bag locking and tracking device constructed in accordance with an embodiment of the disclosed invention.

FIG. 5 provides one possible block diagram 501 of the secured bag locking and tracking device of FIG. 1. Positive terminal 502 provides a source of DC power to the device when it is snapped into the electrical contacts of a secure container. Negative terminal 503 completes this power circuit. Data terminal 504 provides a connection for low-power DC serial communications signals between the SBLTD and the host controller in a secure container. Capacitor 505 filters and conditions the power input to the SBLTD.

Rechargeable battery pack 508 is charged up when power is available at positive terminal 502 and negative terminal 503. Otherwise battery pack 508 provides power to the electronics in the device. Schottky diode 506 is placed between positive power terminal 502 and VCC power signal 520 within the circuitry. This blocking diode 506 is used in conjunction with power detection signal PWRDET, 507, which couples through resistor 509 to an input terminal of microcontroller unit 510. When no DC power is present at positive terminal 502, PWRDET 507 goes low, and diode 506 prevents backflow of potential from battery pack 508 from activating PWRDET 507. PWRDET 507 is used to help control the operating mode of the device, as described further below.

Data coming from the secure container via data pin 504 flows through resistor 511 to the RXD (receive data) pin of MCU 510. Data sent back to the secure container is controlled by MCU 510 signal TXD, which sends a signal through resistor 512, to the base of transistor 513, when needed to operate data line 504 during a serial transmission. Clamp switch 514, within the SBLTD, monitors whether or not the clamp arm is closed. Resistor 515 limits switch current. Signal CLAMP#516 goes low when the unit is clamped and latched. Signal CLAMP# goes high when the unit is unlatched. These signals are coupled to MCU 510.

When the SBLTD is being used outside the secure area, Mode 2, it communicates via an RF link with the secure container. An output pin on MCU 510 causes electronic tether LED 518 to blink periodically by sending current through resistor 517. It will be obvious to one skilled in the art of RF data communications that a number of communications protocols could be used, operating at various frequencies. For example, a wireless networking protocol such as 802.11, or a wireless mesh networking protocol such as Bluetooth, could have been used. However, in the illustrated embodiment, as explained further below, the ZigBee protocol is used, operating at 2.4 GHz. In this Mode 2 operation, MCU 510 communicates over SPI (serial peripheral interface) bus 522 with ZigBee chip 525. ZigBee chip 525 is equipped with ZigBee antenna 526. In order to save power when the unit is not in Mode 2 operation, MCU signal PWRCTL 527 is used to actuate power control circuit 519, which in turn generates power signal VSW 521, which powers ZigBee chip 525.

The unit detects when it is in Mode 1 operation—powered by power pins 502 and 503, and communicating over data pin 504—by the presence of PWRDET 507, as previously described. This condition is used to turn off ZigBee chip 525 as described above. Real-time clock circuit 528 is provided with a 32 kHz crystal 529, and is coupled to MCU 510 via $I^2C$ bus 530. The purpose of this circuit is to allow MCU 510 to time and date stamp all significant events, including the clamping of a bag (as detected by clamp switch 514), or the release of a bag. Time-stamped events are stored in nonvolatile memory within the SBLTD, and can be retrieved later, to help establish continuous custody of the secured items. MCU circuit 510 is coupled via SPI bus 522 to RFID chip 523, which is equipped with RFID antenna 524. When the system is in Mode 1 operation—powered by power pins 502 and 503, and communicating over data pin 504—this SPI connection to RFID chip 523 is inactive.

When the system is not in Mode 1 operation—not powered by power pins 502 and 503—it automatically switches to Mode 2 operation—communicating via ZigBee chip 525—as previously described. More information on automatic mode control is covered by the text that describes FIG. 8, below.

In another embodiment of FIG. 5, the RFID chip 523 is replaced by a low-power RFID reader chip with a serial interface and antenna 524. The RFID reader chip 523 would be positioned within the SBLTD case such that its antenna 524 is immediately below the position of an affixed label with an embedded RFID tag, so that it could retrieve an item description from the affixed RFID tag. The microcontroller within the SBLTD would store that identification information in its nonvolatile memory.

In this embodiment, each SBLTD would have a label affixed to its body to allow people handling the protected items to identify them visually without need of special equipment. A label would be imprinted, for instance during the evidence collecting process, by using a label printer. A printer, such as those used for printing car rental receipts, could be used, except adapted to label stock rather than receipts. In this embodiment, each printable label would incorporate a passive Radio Frequency Identification ("RFID") tag. At the same time that the written description of its contents is being printed in human-readable characters on the label, the printer also stores that description within nonvolatile memory incorporated into the RFID tag. Label printers that incorporate RFID tag read/write circuits are commercially available.

Figure 6:
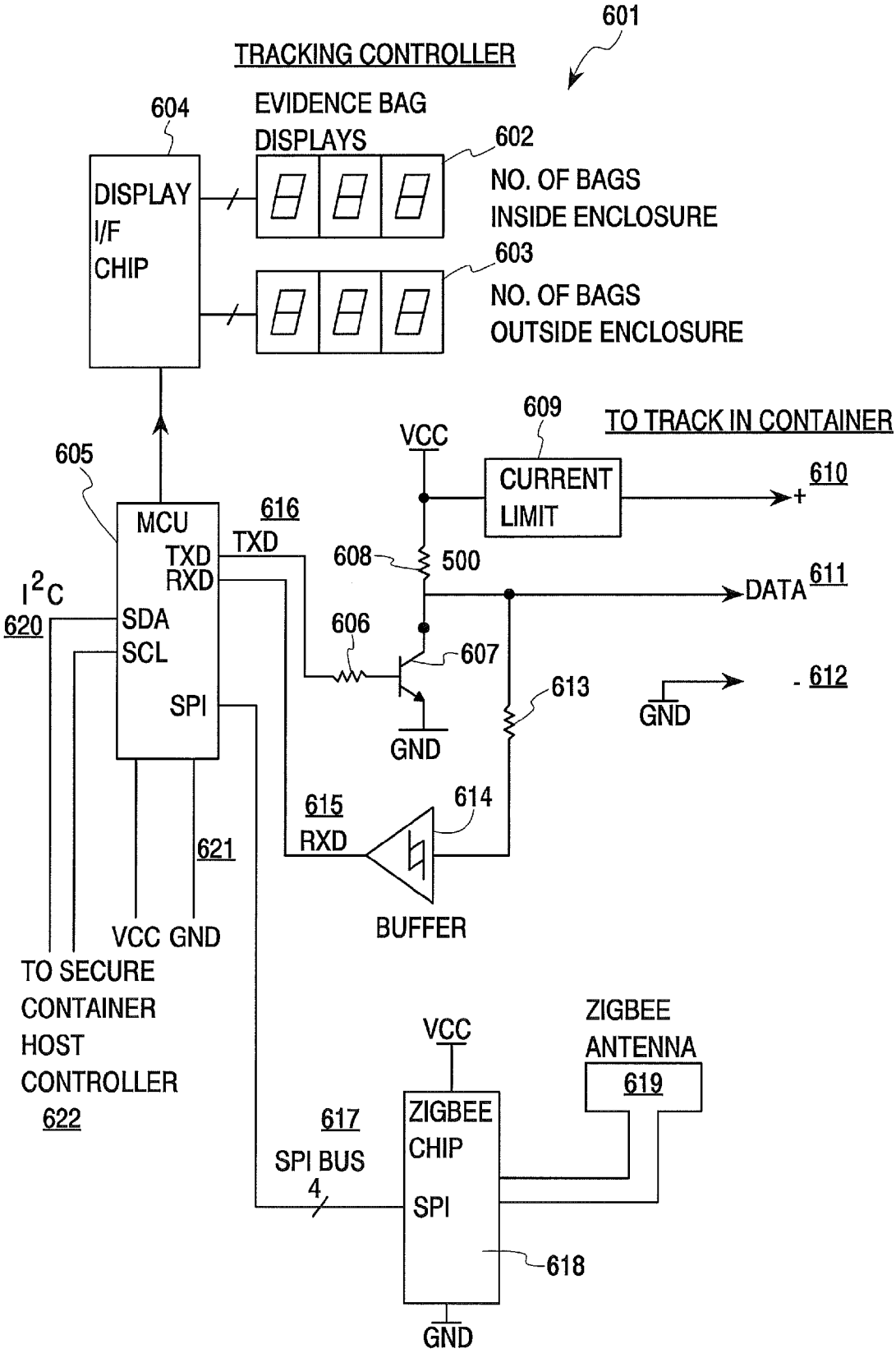
FIG. 6 is a high-level schematic view of the electronic components required to construct the secured bag tracking portion of a secured container constructed in accordance with an embodiment of the disclosed invention.

FIG. 6 provides one possible block diagram 601 of a tracking controller within a secure container. This device provides three-digit numeric display 602 that indicates the number of bags currently being monitored within the enclosure. Three-digit numeric display 603 shows the number of bags electronically tethered via RF link from outside the container. Display interface chip 604 provides actuating signals to displays 602 and 603, based on control signals received from MCU 605. MCU 605 communicates with the electrical track within the container, and through that electrical track, to SBLTD units within the container. Pull-up resistor 608 normally holds the DATA line 611 at an idle high level. The state of DATA pin 611 is passed via protective resistor 613 to isolating buffer 614, and then to RXD signal 615 of MCU 605. When the MCU wishes to communicate with SBLTD units, it actuates TXD signal 616, which turns on transistor 607 through base resistor 606, overcoming pull-up resistor 608, and pulling DATA pin 611 low. One possible data protocol that could be used is asynchronous data at 19,200 bps, with one start bit, 8 data bits, and one stop bit.

Power to SBLTD units within the system passes through protective current limit circuit 609 to positive terminal 610. MCU 605 communicates over SPI bus 617 with ZigBee chip 618, which in turn is equipped with ZigBee antenna 619. This circuitry is provided to communicate via an RF data link with SBLTD units that are operating in Mode 2, positioned outside the secure container. Power to MCU unit 605 derives from power signal 621 (VCC and GND) from secure container host controller 622. Tracking controller 601 is generally under the control of secure container host controller 622 over $I^2C$ bus 620.

Figure 7:
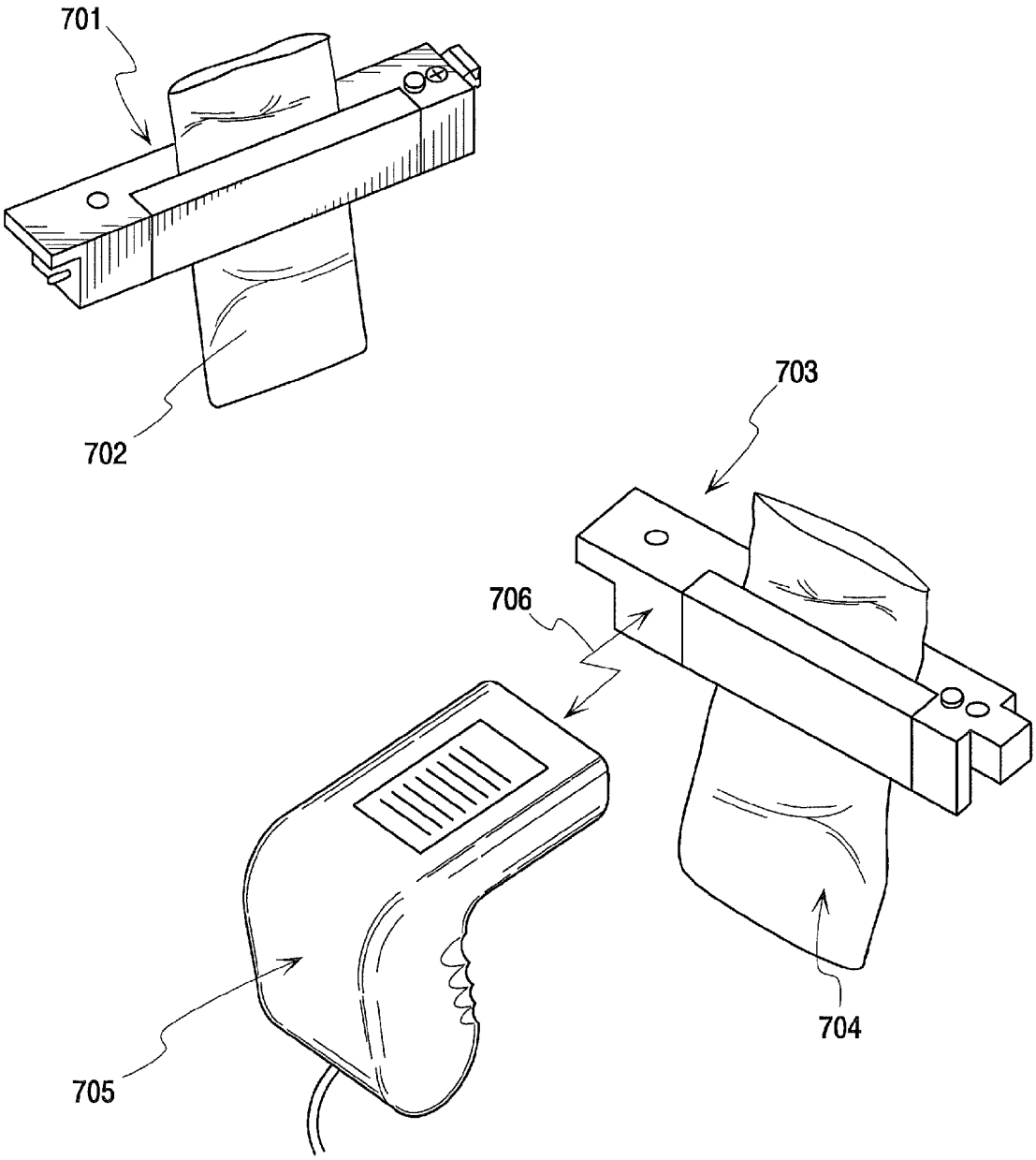
FIG. 7 is an illustration of the operation of a scanning device constructed in accordance with an embodiment of the disclosed invention and used to communicate with the secured bag locking and tracking device of FIG. 1.

FIG. 7 illustrates how devices might be scanned in accordance with the disclosed invention when the devices are operating in storage mode; i.e.; mode 3 as discussed above. Secured bag locking and tracking device 701 is in a storage area, attached to secured bag 702. SBLTD 703 is nearby, attached to secured bag 704. Handheld RFID scanner 705 is held close to the body of SBLTD 703, at which point it can read status information from the RFID tag embodied in the electronics in SBLTD 703.

Figure 8:
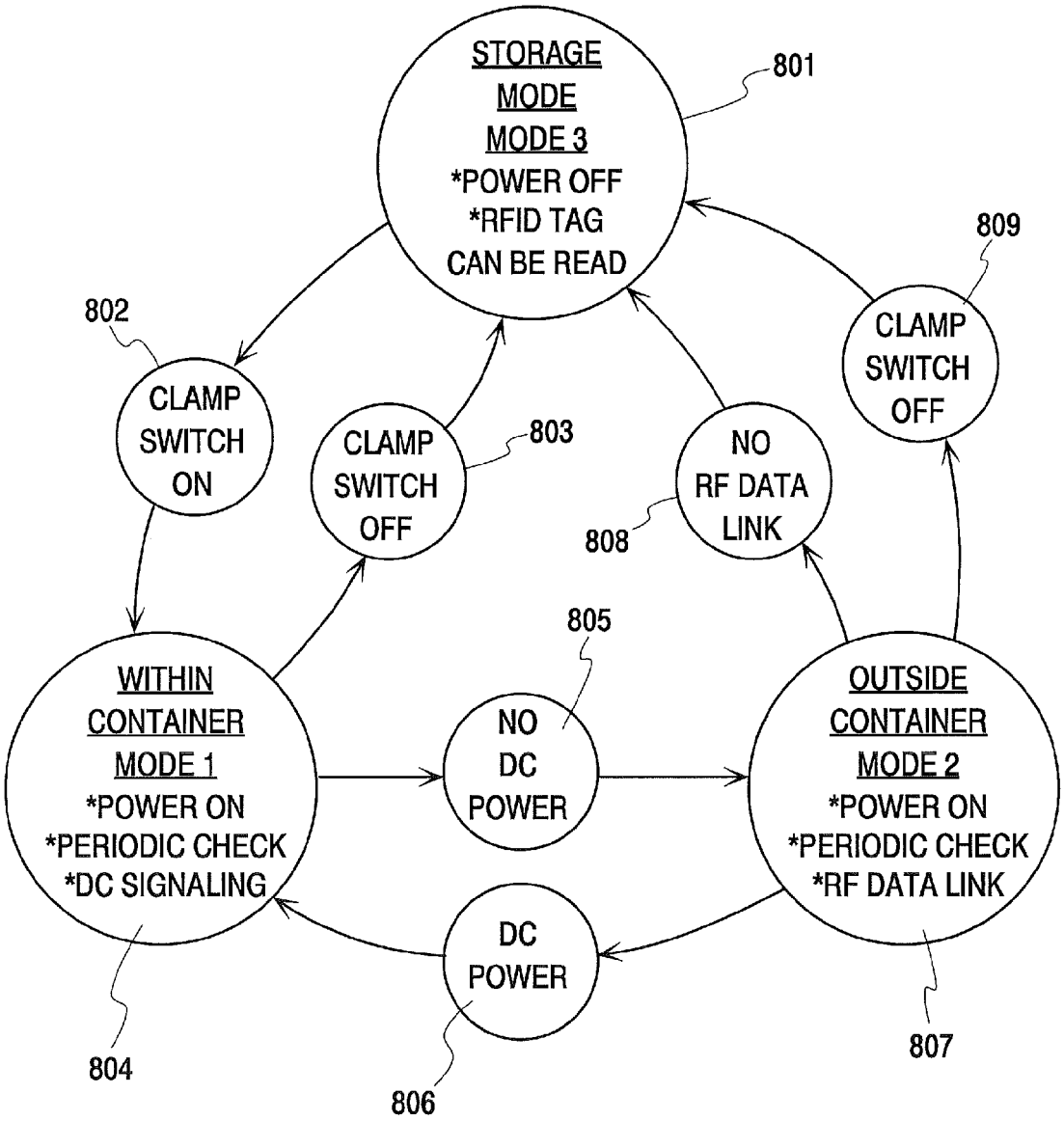
FIG. 8 is a state diagram illustrating logic operating within a processor utilized by the secured container of FIG. 2.

FIG. 8 is a state diagram showing the steps followed by the SLBTD to configure itself automatically to the proper operating mode. The device is in Storage Mode 801 when the clamp switch is off, indicating that no evidence bag is currently latched in. In this mode, the electronic circuitry within the unit is shut down. As an exception, however, the passive RFID tag within the SLBTD is still capable of being read by placing a compatible RFID scanner in contact with the device, as previously illustrated by FIG. 7.

The unit transitions to the Within Container mode 804 when it detects a Clamp Switch On event 802. In Within Container mode 804, the unit is powered on, drawing power from its internal rechargeable battery. It responds to periodic interrogations from tracking controller 601 over a low-power DC signal bus, as previously described. The unit transitions from Within Container Mode 804, back to Storage Mode 803, when it detects a Clamp Switch Off event 803.

The unit transitions to the Outside Container Mode 807, from Within Container Mode 804, when it detects a No DC Power event 805. This indicates that even though it has detected the Clamp Switch On event 802, indicating that the device is intended to be active, it is not within the container, so must transition to Outside Container Mode 807. In this mode, power is drawn from the internal rechargeable battery. In Outside Container Mode 807, the SBLTD switches on its ZigBee data communications circuitry, and attempts to establish a data connection using its ZigBee circuitry with a nearby tracking controller.

If the SLBTD is in Outside Container Mode 807, but is in range of more than one nearby Secure Container, it must be assigned to a specific Secure Container. The procedure for accomplishing this binding is discussed below in the text accompanying FIG. 9. The unit transitions from Outside Container Mode 807, back to Within Container Mode 804, if it detects a DC Power event 806. This transition would not be a routine part of evidence handling, but would be needed in the case where there are multiple secure containers, and it is necessary to place an SBLTD into one of the Secure Containers in order to set up the RF link (as further described in the text accompanying FIG. 9 below). Together with the other transitions, the system supports a complete logical set of operating states, whereby the unit correctly configures itself to the proper operating mode.

While the unit is in Outside Container Mode 807, should it after appropriate retry attempts detect a No RF Data Link event 808, it will transition to Storage Mode 801. Also when the unit is in Outside Container Mode 807, should it detect Clamp Switch Off event 809, it will transition to Storage Mode 801.

Whenever the unit is in either Within Container Mode 804, or Outside Container Mode 807—in other words, in an active mode, with power on—and detects event 803, 805, 806, 808, or 809, it first stores a respective code for that event, along with time and date, in its nonvolatile memory, before making the transition to the new operating mode state. This stored event data provides a data trail that helps establish continuous custody of the items attached to the unit in the plastic bag.

Figure 9:
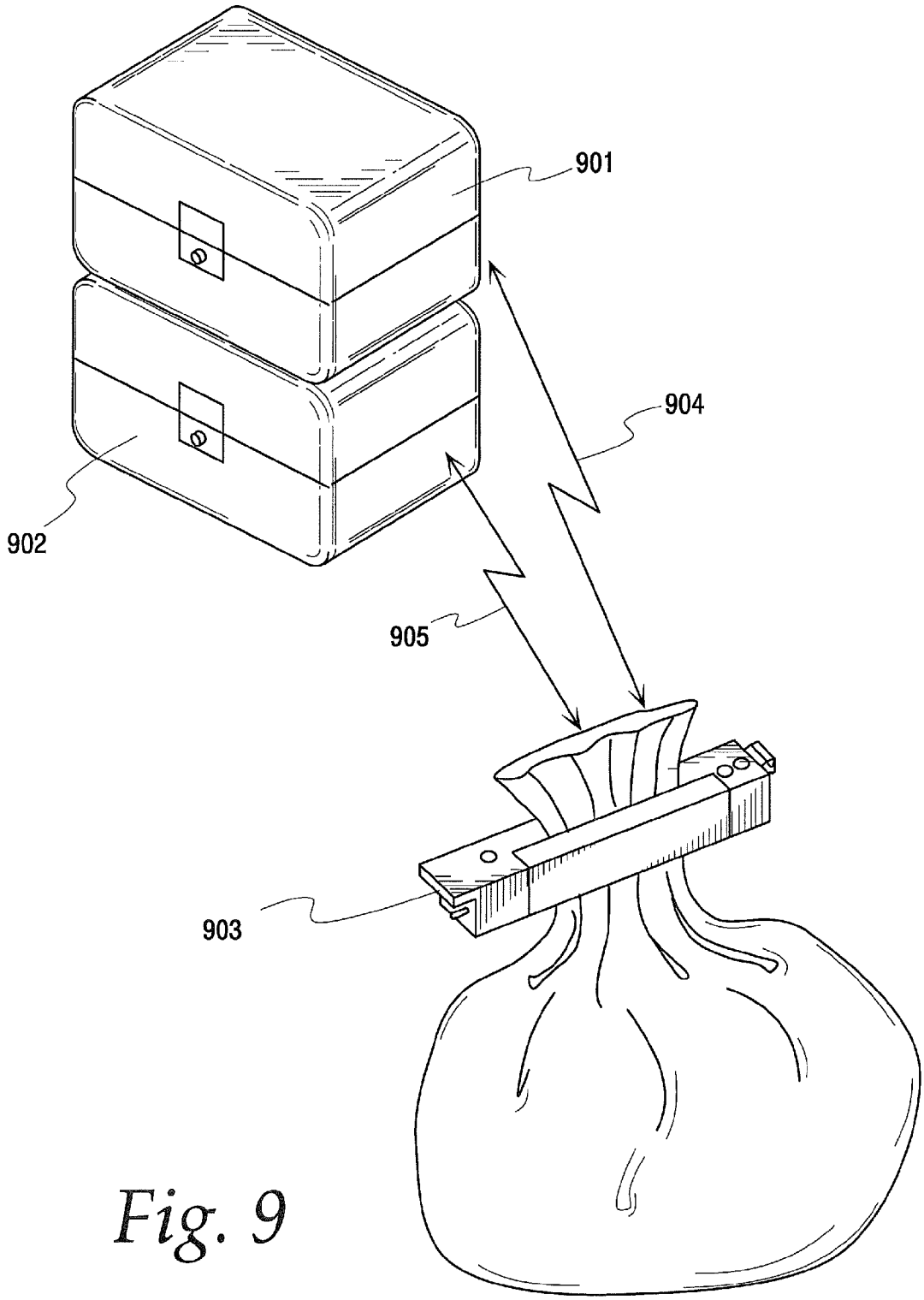
FIG. 9 is an illustration of the operation of a system for securing plastic bags constructed in accordance with an embodiment of the disclosed invention, and specifically illustrating the operation of a wirelessly tethered device with multiple secured containers.

FIG. 9 illustrates a feature of this invention which is necessary when there are multiple Secure Containers in close proximity, and there is at least one SBLTD located outside the containers, which must be electronically tethered to a Secure Container.

FIG. 9 shows Secure Container #1 901, and Secure Container #2 902, which are within close proximity to each other. Obviously there could be more than just two Secure Containers. SBLTD 903 is located is located close to both Secure Containers. Obviously there could be more than just one SBLTD. SBLTD 903 needs to establish a continuous RF data link to a Secure Container in order to provide an electronic record of continuous custody of the attached evidence. In order to provide an unambiguous record of custody, only one of RF data links 904 and 905 can be active.

The system provides a simple means for the operator to bind an SBLTD unit to a specific Secure Container. He opens up the Secure Container, and simply plugs the SLBTD into any unused slot 204. The SBLTD unit communicates with electronic control unit 205 via its data bus pin 504, requesting an identification code unique to this Secure Container. The Secure Container responds with that unique ID code. The SBLTD stores this Secure Container unique ID code within its internal nonvolatile memory. This unique ID code is embodied in all RF communications as between the Secure Container and any SBLTD units to which it is electronically tethered. An SBLTD will respond only to RF data communications messages which embody the matching Secure Container code. Any message received by a Secure Container without the appropriate unique ID code will be disregarded.

This procedure provides a simple means to bind individual SBLTD units to specific Secure Containers, without the need for special tools or complex user interfaces.

The foregoing description of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims set forth below.

What is claimed is:

1. A secure container for controlling and monitoring access to at least one secured bag locking device, said secure container having an interior and an exterior, said at least one secured bag locking device each including a clamp for securing a secured bag and a data port for communicating status information, said secure container comprising: i) a secured locking device for restricting access to the interior of said secure container to authorized personnel; ii) at least one secured bag docking position, said docking position including a power connection and a secured bag occupancy sensor for detecting whether a secured bag is docked when the at least one secured back locking device securing the secured bag is docked on the at least one secured back docking position; iii) a scanner for querying at least one secured bag locking device; and iv) an output device for generating a signal if said at least one secured bag locking device communicates that said clamp has been opened.

2. The secure container of claim 1 wherein said at least one secured bag locking device further includes a radio frequency identification tag and wherein said scanner includes an antenna adapted to communicate with said radio frequency identification tag.

3. The secure container of claim 1 wherein said at least one secured bag locking device further includes a first serial data bus transceiver and wherein said scanner includes a second serial bus transceiver adapted to communicate with said first serial bus transceiver.

4. The secure container of claim 1 wherein said at least one docking position each includes a rail, said rail including a positive contact pin, a negative contact pin, and a data pin.

5. The secure container of claim 2 wherein said radio frequency identification tag is an active radio frequency device tag, and wherein said scanner is adapted to communicate with said active radio frequency device tag within a predetermined distance of said secure container, and wherein said secured bag locking device further comprises an indicator to indicate whether the secured bag locking device is within said predetermined distance of said secure container based on communications between said antenna and said active radio frequency device tag.

6. The secure container of claim 5 further comprising a processor coupled to said scanner, and a display coupled to said processor, and wherein said processor causes said display to display the number of secured bag locking and tracking devices contained within the interior of said secure container and the number of secured bag locking and tracking devices within said predetermined distance of said secure container.

* * * * *